United States Patent [19]

Masaki et al.

[11] 4,030,292

[45] June 21, 1977

[54] METHOD AND APPARATUS OF CONTROLLING AN AIR FUEL MIXTURE FOR A MULTI-CYLINDER INTERNAL COMBUSTION ENGINE

[76] Inventors: Kenji Masaki, No. 30-8, Nagahama, Kanazawa, Yokohama; Hidehiro Minami, No. 18, Nojima-cho, Kanazawa, Yokohama, both of Japan

[22] Filed: June 11, 1975

[21] Appl. No.: 585,828

[30] Foreign Application Priority Data

June 13, 1974 Japan ..... 49-67464

[52] U.S. Cl. ..... 60/274; 60/276; 60/285; 123/32 EA; 123/119 EC

[51] Int. Cl.[2] ..... F02B 75/10

[58] Field of Search ..... 60/274, 276, 285; 123/32 EA, 119 R, 198 F, 119 EC

[56] References Cited

UNITED STATES PATENTS

| | | | |
|---|---|---|---|
| 3,745,768 | 7/1973 | Zechnall | 60/276 |
| 3,800,772 | 4/1974 | Gospodar | 60/284 |
| 3,827,237 | 8/1974 | Linder | 60/285 |
| 3,910,240 | 10/1975 | Omori | 60/276 |
| 3,916,622 | 11/1975 | Gospodar | 60/285 |

*Primary Examiner*—Douglas Hart

[57] ABSTRACT

A first cylinder of an engine is fed with a relatively rich air-fuel mixture during engine low load operation and with a relatively lean air-fuel mixture during medium and high load operations while a second cylinder of the engine is fed with only a relatively lean air-fuel mixture.

11 Claims, 3 Drawing Figures

METHOD AND APPARATUS OF CONTROLLING AN AIR FUEL MIXTURE FOR A MULTI-CYLINDER INTERNAL COMBUSTION ENGINE

The present invention relates generally to a method of and an apparatus for controlling the air-fuel ratio of an air-fuel mixture for a multi-cylinder internal combustion engine a cylinder or cylinders of which are supplied with a relatively rich air-fuel mixture and the remaining cylinder or cylinders of which are supplied with a relatively lean air-fuel mixture and particularly to a method of and an apparatus for controlling an air-fuel mixture for a multi-cylinder internal combustion engine so that a cylinder or cylinders of the engine are supplied with a relatively rich air-fuel mixture during low load engine operation and with a relatively lean air-fuel mixture during engine medium and high load operations while the remaining cylinder or cylinders of the engine are always supplied with the relatively lean air-fuel mixture during engine operation.

As is well known in the art, an internal combustion engine produces exhaust gas containing harmful components such as nitrogen oxides (NOx), hydrocarbons (HC) and carbon monoxide (CO). The amount of nitrogen oxides produced by the engine reaches a maximum when the air-fuel ratio of an air-fuel mixture burned in the engine is equal to or near a stoichiometric air-fuel ratio. Accordingly, in order to reduce the production of nitrogen oxides, it is desirable for the engine to employ either a rich or lean air-fuel mixture having an air-fuel ratio lower or higher respectively than a stoichiometric air-fuel ratio. When the engine employs the lean air-fuel mixture, it produces exhaust gas containing smaller amounts of hydrocarbons and carbon monoxide as compared with the rich air-fuel mixture. However, in order to completely or effectively oxidize hydrocarbons and carbon monoxide into harmless components such as carbon dioxides and water in an exhaust gas reburning device such as an intake manifold or a thermal reactor of the engine when the temperature of the exhaust gas is relatively low, it is desirable for the exhaust gas to contain a larger amount of carbon monoxide. Accordingly, in order to reduce the amounts of nitrogen oxides, hydrocarbons and carbon monoxide discharged into the atmosphere by using the exhaust gas reburning device, it is desirable for the engine to employ a rich air-fuel mixture only. However, this results in extremely high fuel consumption.

Thus, a rich and lean mixture supply system has been proposed in which a cylinder or cylinders of an engine are supplied with a rich air-fuel mixture having an air-fuel ratio, for example, lower than 14:1 while the remaining cylinder or cylinders of the engine are supplied with a lean air-fuel mixture having an air-fuel ratio, for example, higher than 18:1, the rich and lean air-fuel mixtures are alternately burned, and larger amounts of hydrocarbons and carbon monoxide, as compared with the lean air-fuel mixture, contained in the exhaust gas resulting from combustion of the rich air-fuel mixture are oxidized and rendered harmless by reaction in the exhaust gas reburning device with excessive oxygen contained in the exhaust gas resulting from combustion of the lean air-fuel mixture.

However, such a conventional rich and lean mixture supply system has a disadvantage in that fuel consumption is not minimized. That is, although, when the engine is in cold operation or in low load operation during which because of the relatively low temperature of the exhaust gas the exhaust gas reburning device isn't sufficiently active to oxidize burnable harmful components in the exhaust gas, it is necessary to increase the concentrations of hydrocarbons and carbon monoxide to render the exhaust gas reburning device active, when the engine is in medium or high load operation during which because of the relatively high temperature of the exhaust gas the exhaust gas reburning device is active to oxidize the burnable harmful components, even if the engine employs the lean air-fuel mixture only to produce exhaust gas containing smaller amounts of hydrocarbons and carbon monoxide as compared with the rich air-fuel mixture, the exhaust gas reburning device can satisfactorily or effectively oxidize the burnable harmful components.

It is, therefore, an object of the invention to provide a method of and an apparatus for controlling an air-fuel mixture for an engine to supply a cylinder or cylinders of the engine with a rich air-fuel mixture during engine low load operation and with a lean air-fuel mixture during engine medium and high load operations and to supply the remaining cylinder or cylinders of the engine with the lean air-fuel mixture during all engine operations.

This and other objects and advantages of the invention will become more apparent from the following detailed description taken in connection with the accompanying drawings in which.

Figure 1:
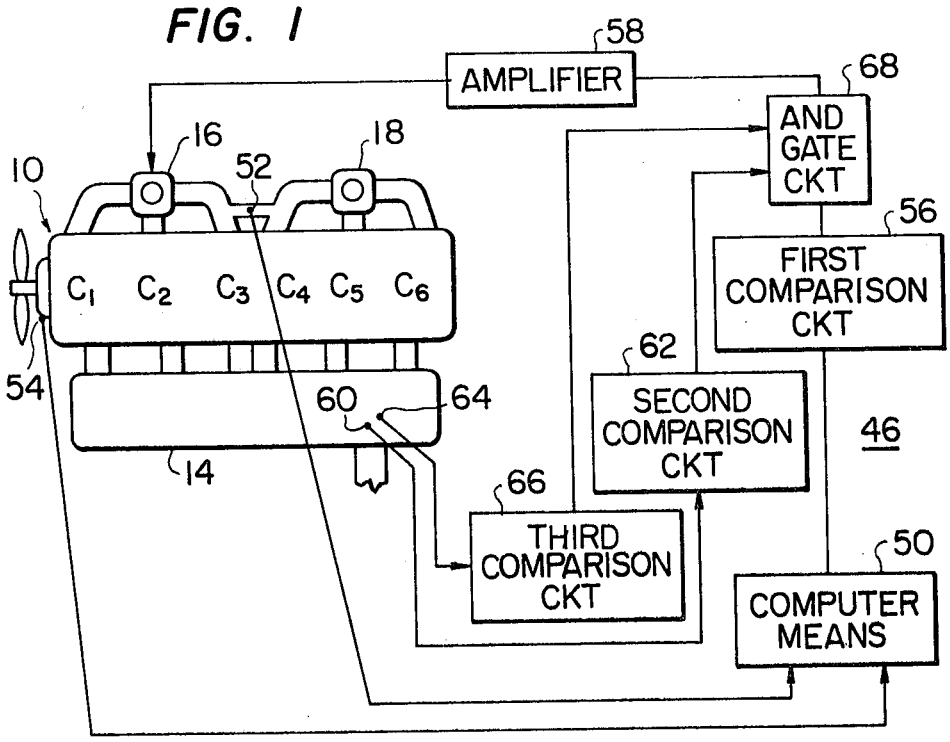
FIG. 1 is a schematic view of a first preferred embodiment of an apparatus according to the invention.

Referring to FIG. 1 of the drawings, an apparatus according to the invention for controlling an air-fuel mixture for a multi-cylinder internal combustion engine is shown as being applied to a six cylinder, spark ignition type engine which is generally designated by the reference numeral 10. The six cylinders of the engine 10 are arranged in a first group of three cylinders $C_1$ to $C_3$ and a second group of remaining three cylinders $C_4$ to $C_6$. The exhaust ports (not shown) of the individual cylinders $C_1$ to $C_6$ communicate with an exhaust gas treating or reburning device such as a thermal reactor 14 which effects oxidation of burnable harmful constituents such as hydrocarbons (HC) and carbon monoxide (CO) in the exhaust gas discharged from the engine 10 to purify or decontaminate the exhaust gas.

The apparatus comprises a first carburetor 16 for feeding an air-fuel mixture to the first group of cylinders $C_1$ to $C_3$ and a second carburetor 18 for feeding an air-fuel mixture to the second group of cylinders $C_4$ to $C_6$. The first carburetor 16 is constructed and arranged to feed a relatively rich air-fuel mixture having an air-fuel ratio lower than a predetermined air-fuel ratio such as, for example, a stoichiometric air-fuel ratio during a first operation, such as low load operation, of the engine 10 during which operation because of the relatively low temperature of the engine exhaust gas the exhaust gas treating device is inactive to oxidize the burnable harmful components in the engine exhaust gas; and a relatively lean air-fuel mixture having an air-fuel ratio higher than the predetermined air-fuel ratio during a second operation, such as medium and high load operations, of the engine 10 during which operation because of the relatively high temperature of the engine exhaust gas the exhaust gas treating device is active to oxidize the burnable harmful components in the engine exhaust gas. The second carburetor 18 is constructed and arranged to feed a relatively lean air-fuel mixture having the air-fuel ratio higher than the predetermined air-fuel ratio during all operations of the engine 10.

Figure 2:
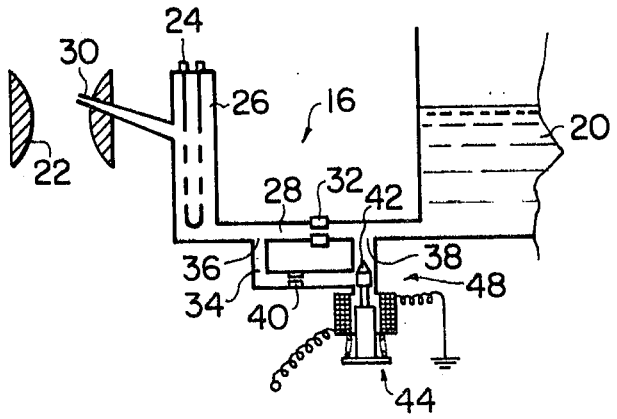
FIG. 2 is a schematic view of a first carburetor employed in the apparatus shown in FIG. 1.

Referring to FIG. 2 of the drawings, a portion of the first carburetor 16 is shown in detail and in an enlarged scale to comprise a float bowl or chamber 20 containing fuel, a venturi 22 communicating with the first group of cylinders $C_1$ to $C_3$ for passing air therethrough, an air bleed 24 vented from the atmosphere, an air-fuel mixer or emulsifier 26 communicated with the air bleed 24 and fed with air from the air bleed 24, a fuel passageway 28 interconnecting the float chamber 20 and the air-fuel mixer 26 for feeding fuel thereto, and a discharge nozzle 30 communicating with the air-fuel mixer 26 and opening into the venturi 22 for discharge of fuel thereinto and to mix the fuel with the inducted air. The fuel passageway 28 is formed therein with a main jet or orifice 32 having a cross sectional area which is selected to control or meter the flow of fuel passing therethrough to the venturi 22 to form the relatively lean air-fuel mixture mentioned above.

A by-pass fuel passageway 34 is provided for feeding additional fuel to the discharge nozzle 30. The by-pass passageway 34 extends around the main jet 32, with its opposite ends 36 and 38, respectively, in communication with the fuel passageway 28 at locations downstream and upstream of the main jet 32. The by-pass passageway 34 is formed therein with an auxiliary jet or orifice 40 having a cross sectional area which is selected to control or meter the flow of the additional fuel passing therethrough to the venturi 22 to form the relatively rich air-fuel mixture mentioned above in cooperation with the fuel metered by the main jet 32. A valve 42 is disposed in the by-pass passageway 34 at a location upstream of the auxiliary jet 40. A solenoid 44 is provided for controlling the valve 42. The valve 42 is normally held in a position to open the by-pass passageway 34 to feed fuel through both the main and auxiliary jets 32 and 40 so that a relatively rich air-fuel mixture is fed by the first carburetor 16 when the solenoid 44 is deenergized. The valve 42 is moved by the solenoid 44 into a position to block the by-pass passageway 34 to feed fuel through only the main jet 32 during medium and high load operations of the engine 10 so that a relatively lean air-fuel mixture is fed by the first carburetor 16 when the solenoid 44 is energized. The solenoid 44 is controlled by an electric control device or circuit which is generally designated by the reference numeral 46 in FIG. 1 and which will be described hereinafter in detail.

The by-pass passageway 34, the auxiliary jet 40, the valve 42 and the solenoid 44 serve as a mixture enriching and weakening device 48 which enriches the mixture fed by the first carburetor 16 from the relatively lean air-fuel mixture into the relatively rich air-fuel mixture when the valve 42 opens the by-pass passageway 34 and which weakens the mixture fed by the first carburetor 16 from the relatively rich air-fuel mixture into the relatively lean air-fuel mixture when the valve 42 blocks the by-pass passageway 34.

The first carburetor 16 may comprise a modified mixture enriching and weakening device in lieu of the above-mentioned enriching and weakening device 48. The modified mixture enriching and weakening device comprises a jet 32 having a cross sectional area which is selected to meter the flow of fuel passing therethrough to the venturi 22 to form the relatively rich air-fuel mixture set forth above, and means (not shown) for feeding additional air into the air-fuel mixer 26. The additional air feeding means comprises a valve, such as operated by a solenoid, which is operable to permit feed of additional air into the air-fuel mixer 26 during medium and high load operations of the engine 10 to weaken the mixture fed by the first carburetor 16 from the relatively rich air-fuel mixture to the relatively lean air-fuel mixture and to inhibit feed of additional air into the air-fuel mixer 26 during low load operation of the engine 10 to enrich the mixture fed by the first carburetor 16 from the relatively lean air-fuel mixture to the relatively rich air-fuel mixture.

The second carburetor 18 is different from the first carburetor 16 in that it comprises a venturi 22 communicating with the second group of cylinders $C_4$ to $C_6$ for passing air for the cylinders $C_4$ to $C_6$ therethrough, and a jet 32 having a cross sectional area which is selected to control or meter the flow of fuel passing therethrough to the venturi 22 to form the relatively lean air-fuel mixture, and in that it does not have a mixture enriching and weakening device 48.

Returning to FIG. 1 of the drawings, the electric control device 46 is shown to comprise computer means 50 which is fed with electric signals corresponding respectively to the intake manifold vacuum and the rotational speed of the engine 10 from suitable sensors 52 and 54. The computer means 50 calculates the momentary load of the engine 10 from the signals and generates an output signal corresponding to the momentary engine load. The computer means 50 is connected to a first comparison or comparator circuit 56 to apply the output signal thereto. The comparison circuit 56 compares the level of the output signal of the computer means 50 with a predetermined value, which is indicative of the engine 10 reaching medium load, and generates an output signal when the level of the output signal exceeds the predetermined value, that is, when the engine 10 is in medium or high load operating condition. The comparison circuit 56 is connected to an amplifier 58 to apply the output signal thereto. The amplifier 58 amplifies the output signal of the comparison circuit 56 and generates an energizing signal having an amplified width. The amplifier 58 is connected to the solenoid 44 to apply the energizing signal thereto so that the solenoid 44 is energized.

The electric control device 46 may comprise disabling means which keeps or renders the solenoid 44 deenergized even if the engine 10 is in medium or high load operating condition so that the first carburetor 16 feeds the relatively rich air-fuel mixture when the engine 10 is in cold operation during which because of the relatively low temperature of the engine exhaust gas the thermal reactor 14 is ineffective or inactive to oxidize burnable harmful components in the exhaust gas discharged from the engine 10 and/or when the engine 10 encounters misfiring of the air-fuel mixture in its combustion chamber or chambers and accordingly the engine exhaust gas contains an excessively high concentration of oxygen. The disabling means comprises a temperature sensor 60 which is located in the thermal reactor 14 for sensing the temperature in the thermal reactor. A second comparison or comparator circuit 62 is provided which is fed from the temperature sensor 60 with an output signal indicative of the temperature of the thermal reactor 14. The second comparison circuit 62 compares the level of the temperature signal with a predetermined value and generates an output signal when the level of the signal exceeds the predetermined value, that is, when the temperature of the engine exhaust gas is higher than a predetermined value. An oxygen meter or sensor 64 is provided in the thermal reactor 14 for sensing the content of oxygen in the engine exhaust gas. A third comparison or comparator circuit 66 is provided which is fed with an output signal indicative of the oxygen content from the oxygen sensor 64. The third comparison circuit 66 generates an output signal when the oxygen content in the engine exhaust gas is lower than a predetermined level. An AND gate logic circuit 68 is provided which has three input terminals connected respectively to the first, second and third comparison circuits 56, 62 and 66 and an output terminal connected to the amplifier 58. The AND gate circuit 68 generates an output signal, which is applied to the amplifier 58, only when the output signals of the first, second and third comparison circuits 56, 62 and 66 are concurrently applied to the AND gate circuit 68.

With the arrangement of FIGS. 1 and 2 thus far described, the second group of cylinders $C_4$ to $C_6$ are fed with the relatively lean air-fuel mixture from the second carburetor 18 during operation of the engine 10. When the engine 10 is in low load operating condition, the first comparison circuit 56 generates no output signal to keep or render the solenoid 44 deenergized so that the valve 42 is held in a position to open the by-pass passagewy 34. Thus, the first group of cylinders $C_1$ to $C_3$ are fed with the relatively rich air-fuel mixture from the first carburetor 16.

When the engine 10 is in medium or high load operating condition, the first comparison circuit 56 generates an output signal to energize the solenoid 44 so that the valve 42 is moved thereby into a position to block the by-pass passageway 34. Thus, the first group of cylinders $C_1$ to $C_3$ are fed with the relatively lean air-fuel mixture from the first carburetor 16, similarly to the second group of cylinders $C_4$ to $C_6$ which are fed with the relatively lean air-fuel mixture from the second carburetor 18.

When the engine 10 is cold and/or encounters misfiring of the air-fuel mixture in its combustion chamber or chambers, the second and/or third comparison circuit 62 and/or 66 generates no output signal so that the AND gate circuit 68 generates no output signal to keep or render the solenoid 44 deenergized. Thus, the valve 42 is held in a position to open the by-pass passageway 34. Accordingly, even if the engine 10 is in medium or high load operating condition, the first group of cylinders $C_1$ to $C_3$ are fed with the relatively rich air-fuel mixture from the first carburetor 16. As a result, the thermal reactor 14 is fed with the engine exhaust gas containing relatively high concentrations of hydrocarbons and carbon monoxide from the first group of cylinders $C_1$ to $C_3$. Thus, when the engine 10 is cold, the thermal reactor 14 is quickly heated to a desired or satisfactory temperature at which it is effective or active to oxidize burnable harmful components in the engine exhaust gas. When the engine 10 encounters misfiring, the thermal reactor 14 is prevented from being damaged by drastic combustion of an unburned air-fuel mixture in the presence of an excessively high concentration of oxygen.

Figure 3:
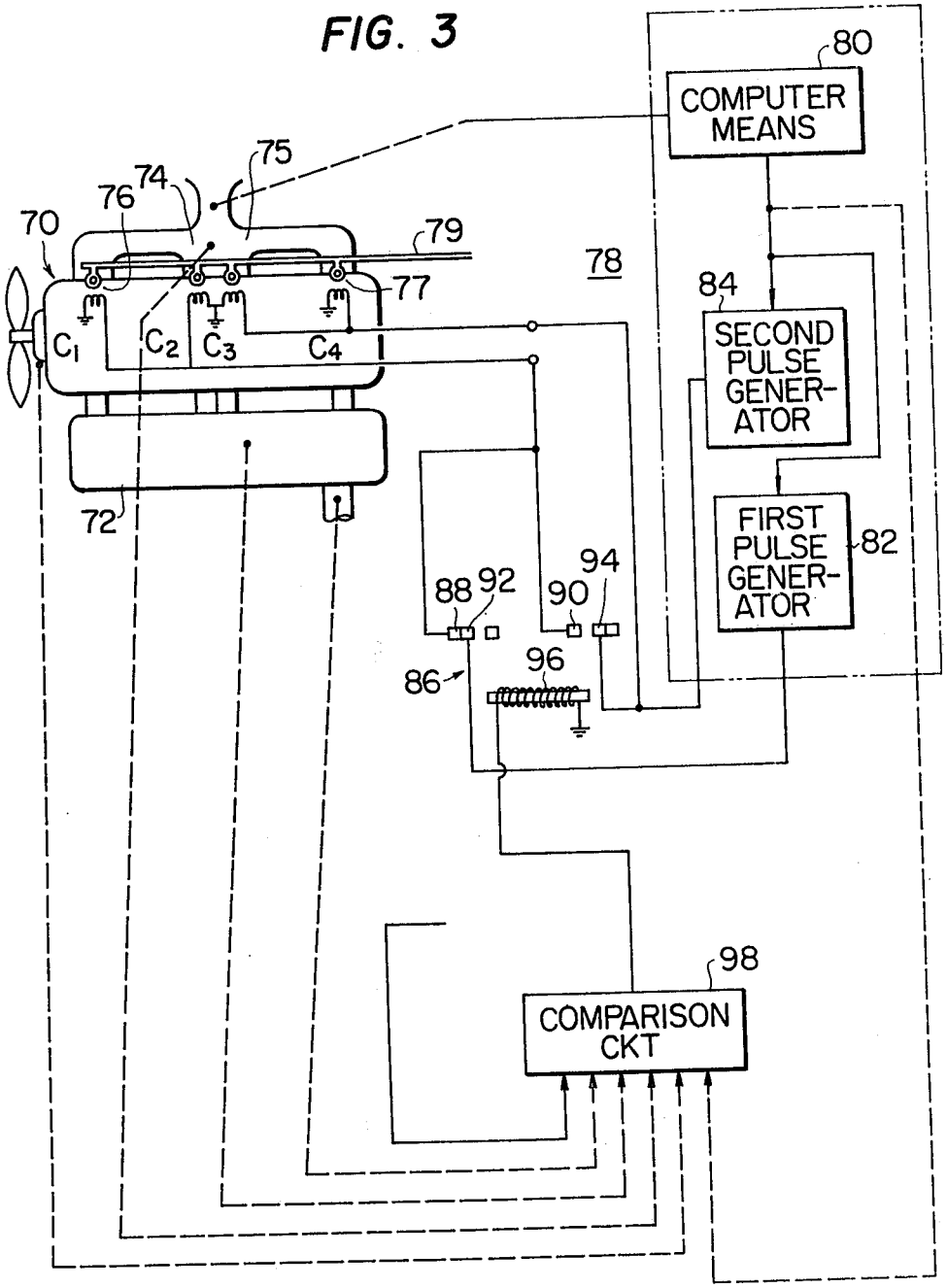
FIG. 3 is a schematic view of a second preferred embodiment of an apparatus according to the invention.

Referring to FIG. 3 of the drawings, a second preferred embodiment of an apparatus according to the invention for controlling an air-fuel mixture for a multi-cylinder internal combustion engine is shown as being applied to a four cylinder, fuel injection type engine which is generally designated by the reference numeral 70. The four cylinders of the engine 70 are arranged in a first group of two cylinders $C_1$ and $C_2$ and a second group of remaining two cylinders $C_3$ and $C_4$. The exhaust ports (not shown) of the individual cylinders $C_1$ to $C_4$ communicate with a thermal reactor 72 which performs oxidations of burnable harmful constituents such as hydrocarbons (HC) and carbon monoxide (CO) in the exhaust gas discharged from the engine 70 to purify or decontaminate the exhaust gas.

The apparatus comprises first air feeding passage means 74 for feeding air to each of the cylinders $C_1$ and $C_2$, second air feeding passage means 75 for feeding air to each of the cylinders $C_3$ and $C_4$, a first group of fuel injection valves or injectors 76 for feeding or injecting fuel into the air fed to the cylinders $C_1$ and $C_2$, and a second group of fuel injection valves or injectors 77 for feeding or injecting fuel into the air fed to the cylinders $C_3$ and $C_4$. The first and second groups of fuel injection valves 76 and 77 are fed with fuel under pressure from a distributing pipe 79 which communicates with a fuel pump (not shown). The first group of fuel injection valves 76 are arranged to feed a relatively large amount of fuel during a first operation, such as low load operation, of the engine 70 to form the relatively rich air-fuel mixture as mentioned hereinbefore with reference to the embodiment of FIGS. 1 and 2 and to feed a relatively small amount of fuel during a second operation, such as medium and high load operation, of the engine 70 to form the relatively lean air-fuel mixture as mentioned hereinbefore with reference to the embodiment of FIGS. 1 and 2. The second group of fuel injection valves 77 are arranged to feed a relatively small amount of fuel during all operations of the engine 70 to form the relatively lean air-fuel mixture set forth above.

An electronic control device or circuit generally designated by the reference numeral 78 is provided to control the fuel injection valves 76 and 77. The electronic control device 78 comprises computer means 80 which is fed with an electric signal corresponding to the amount of air drawn into the engine 70. The computer means 80 calculates the momentary load of the engine 70 from the fed electric signal and generated an output signal indicative of the momentary engine load. The computer means 80 is connected to first and second pulse generators 82 and 84. The first pulse generator 82 is connected to the first group of fuel injection valves 76 during low load operating condition of the engine 70. The second pulse generator 84 is connected to the first group of fuel injection valves 76 during medium and high load operating conditions of the engine 70 and is continuously connected to the second group of fuel injection valves 77. Each of the first and second pulse generators 82 and 84 calculates the amount of fuel to be injected per injection by the corresponding group of fuel injection valves 76 or 77 on the basis of the output signal of the computer means 80 and on operating variable such as, for example, the speed of the engine 70 and generates a pulse signal which has a pulse width or time duration corresponding to the amount of fuel to be injected and which is applied to the corresponding group of fuel injection valves 76 or 77. The first pulse generator 82 is set to generate a pulse signal having a relatively long or wide pulse width which causes the first group of fuel injection valves 76, when being connected therewith, to inject the relatively large amount of fuel set forth above. The second pulse generator 84 is set to generate a pulse signal having a relatively short or narrow pulse width which causes the first and/or second group of fuel injection valves 76 and/or 77, when being connected therewith, to inject the relatively small amount of fuel set forth above.

A switching or transfer relay 86 is provided to control connection between the first group of fuel injection valves 76 and the first and second pulse generators 82 and 84. The switching relay 86 comprises spaced first and second stationary contacts 88 and 90 which are connected to the first group of fuel injection valves 76, first and second movable contacts 92 and 94 which are connected respectively to the first and second pulse generators 82 and 84 and which are connectable respectively with the first and second stationary contacts 88 and 90, and a relay coil 96. The first movable contact 92 is connected with the first stationary contact 88 while the second movable contact 94 is disconnected from the second stationary contact 90 when the relay coil 96 is deenergized, as shown in the drawing.

Control means such as a comparison circuit 98 is provided for controlling the relay coil 96. The comparison circuit 98 is fed with the output signal of the computer means 80, an electric signal representative of the temperature of exhaust gas of the engine 70, and an electric signal representative of the concentration of oxygen in exhaust gas of the engine 70 as shown by dotted lines in FIG. 3 and generates an energizing signal, which is applied to the relay coil 96 to energize it, when the level of the output signal of the computer means 80 exceeds a predetermined value, that is, when the engine 70 is in medium or high load operating condition, and concurrently when the temperature of the engine exhaust gas is above a predetermined value and when the concentration of oxygen in the engine exhaust gas is below a predetermined value. The comparison circuit 98 fails to generate an energizing signal when the engine 70 is in a low load operating condition, and concurrently when the temperature of the engine exhaust gas is below the predetermined value and when the concentration of oxygen in the engine exhaust gas is above the predetermined value. Furthermore, when the engine 70 is in the low load operating condition, the comparison circuit 98 fails to generate an energizing signal when the temperature of the engine exhaust gas is below the predetermined value or when the concentration of oxygen in the engine exhaust gas is above the predetermined value. The relay coil 96, when being energized, causes disconnection of the first movable contact 92 from the first stationary contact 88 and connection of the second movable contact 94 to the second stationary contact 90. The comparison circuit 98 can be fed with an electric signal representative of the engine speed and an electric signal representative of the engine suction or the vacuum in one of the air feeding passage means 74 and 75 as shown by dotted lines in FIG. 3 as parameters representing the load of the engine 70, in lieu of the output signal form the computer means 80.

An AND gate logic circuit (not shown) may be provided which is fed with, as input signals, the output signalof the comparison circuit 98 and electric signals indicative of operating variables such as engine speed, intake manifold vacuum, engine exhaust gas temperature, exhaust gas oxygen content and/or vehicle speed as shown by the dotted lines in the drawing and which has an output terminal connected to the relay coil 96. The AND gate circuit controls the timing of energization of the relay coil 96 in accordance with these operating variables.

With the arrangement of FIG. 3 thus far described, the second group of cylinders $C_3$ and $C_4$ are fed with the relatively lean air-fuel mixture by the second air feeding passage means 75 and the second group of fuel injection valves 77 during operation of the engine 70. When the engine 70 is operating at low load, the comparison circuit 98 generates no output signal to keep or render the relay coil 96 deenergized so that the first pulse generator 82 is connected to the first group of fuel injection valves 76. Thus, the first group of cylinders $C_1$ and $C_2$ are fed with the relatively rich air-fuel mixture by the first air feeding passage means 74 and the first group of fuel injection valves 76.

When the engine 70 is in medium or high load operating condition, the comparison circuit 98 generates the output signal to energize the relay coil 96 so that the first pulse generator 82 is disconnected from the first group of fuel injection valves 76 and the second pulse generator 84 is connected to the first group of fuel injection valves 76. Thus, an air-fuel mixture fed to the first group of cylinders $C_1$ and $C_2$ by the first air feeding passage means 74 and the first group of fuel injection valves 76 is switched over from the relatively rich air-fuel mixture to the relatively lean air-fuel mixture.

It will be appreciated that fuel consumption is minimized by controlling the air-fuel ratio of an air-fuel mixture for an engine in accordance with the operating condition of the engine so that a cylinder or cylinders of the engine are fed with a relatively rich air-fuel mixture when the engine is in a first operating condition which is ineffective to reburn burnable harmful components in the engine exhaust gas and with a relatively lean air-fuel mixture when the engine is in a second operating condition which is effective to reburn the burnable harmful components and the remaining cylinder or cylinders of the engine are fed with the relatively lean air-fuel mixture.

What is claimed is:

1. An apparatus for controlling an air-fuel mixture for a multi-cylinder internal combustion engine, comprising first mixture feeding means for feeding a relatively rich air-fuel mixture having an air-fuel ratio lower than a predetermined air-fuel ratio and a relatively lean air-fuel mixture having an air-fuel ratio higher than said predetermined air-fuel ratio to a first cylinder of a multi-cylinder internal combustion engine, second mixture feeding means for feeding a relatively lean air-fuel mixture having said air-fuel ratio higher than said predetermined air-fuel ratio to a second cylinder of said engine during operation of said engine, and control means for controlling said first mixture feeding means in accordance with an operating parameter of said engine to feed said relatively rich air-fuel mixture during a first operation of said engine when an exhaust gas treating device of said engine is inactive to oxidize burnable harmful components in the exhaust gas discharged from said engine and to feed said relatively lean air-fuel mixture during a second operation of said engine when said exhaust gas treating device is active to oxidize said burnable harmful components, in which said first and second mixture feeding means comprise first and second carburetors, respectively, said first carburetor comprising mixture enriching means operative to enrich a fuel mixture fed by said first carburetor from said relatively lean air-fuel mixture to said relatively rich air-fuel mixture, said control means rendering said mixture enriching means inoperative in response to an engine load in excess of low load.

2. An apparatus as claimed in claim 1, in which said first carburetor comprises a venturi for passing air for said first cylinder therethrough, a discharge nozzle opening into said venturi for discharge of fuel thereinto and mixture of said fuel with said air, a passageway for feeding fuel to said nozzle, a main jet formed in said passageway and having a cross sectional area selected to meter the flow of fuel passing therethrough to form said relatively lean air-fuel mixture, a by-pass passageway for feeding additional fuel to said nozzle, an auxiliary jet formed in said by-pass passageway and having a cross sectional area selected to meter the flow of said additional fuel passing therethrough to form said relatively rich air-fuel mixture in cooperation with said fuel fed through said main jet, said mixture enriching means comprising a normally open valve disposed in said by-pass passageway at a location upstream of said auxiliary jet, and a solenoid for moving said valve into a position to close said by-pass passageway when energized, said control means energizing said solenoid in response to the load of said engine which is in excess of low load.

3. An apparatus as claimed in claim 2, in which said control means comprises a comparison circuit connected to said solenoid and generating an output signal to energize said solenoid in response to the load of said engine exceeding low load.

4. An apparatus as claimed in claim 2, in which said control means comprises a first comparison circuit generating an output signal in response to the load of said engine which is in excess of low load, and a second comparison circuit generating an output signal in response to the temperature of the exhaust gas of said engine which is in excess of a predetermined value, and an AND gate logic circuit connected to said first and second comparison circuits and to said solenoid and generating an output signal to energize said solenoid when said first and second comparison circuits concurrently generate said output signals.

5. An apparatus as claimed in claim 2, in which said control means comprises a first comparison circuit generating an output signal in response to the load of said engine which is in excess of low load, a second comparison circuit generating an output signal in response to the temperature of the exhaust gas of said engine which is in excess of a predetermined value, a third comparison circuit generating an output signal in response to the content of oxygen in the exhaust gas of said engine which is lower than a predetermined value, and an AND gate logic circuit connected to said solenoid and to said first, second and third comparison circuits and generating an output signal to energize said solenoid when said first, second and third comparison circuits concurrently generate said output signals.

6. A method of controlling an air-fuel mixture for an internal combustion engine, comprising a first step of alternatively forming a relatively rich air-fuel mixture having an air-fuel ratio lower than a predetermined air-fuel ratio and, a relatively lean air-fuel mixture having an air-fuel ratio higher than said predetermined air-fuel ratio for a first combustion chamber of said engine, a second step of forming a relatively lean air-fuel mixture having said air-fuel ratio higher than said predetermined air-fuel ratio for a second combustion chamber of said engine during all operations of said engine, a third step of sensing a first load condition in which the load of said engine is below a predetermined value and a second load condition in which the load of said engine is above said predetermined value and producing first and second control signals representative of said first and second load conditions, respectively, a fourth step of sensing a temperature of exhaust gas of said engine which is above a predetermined value and producing a third control signal representative of said temperature, a fifth step of sensing a concentration of oxygen in exhaust gas of said engine which is below a predetermined value and producing a fourth control signal representative of said concentration, and a sixth step of causing said first step to form said rich air-fuel mixture when said third step produces said first control signal and at least one of said fourth and fifth steps fails to produce the corresponding control signal and causing said first step to form said lean air-fuel mixture when said third, fourth and fifth steps concurrently produce said second, third and fourth control signals, respectively.

7. A method as claimed in claim 6, in which said predetermined air-fuel ratio is a stoichiometric airfuel ratio.

8. An apparatus for controlling an air-fuel mixture for an internal combustion engine, comprising first air-fuel mixture forming means for forming a relatively rich air-fuel mixture having an air-fuel ratio lower than a predetermined air-fuel ratio and a relatively lean air-fuel mixture having an air-fuel ratio higher than said predetermined air-fuel ratio for a first combustion chamber of said engine, second air-fuel mixture forming means for forming a relatively lean air-fuel mixture having said air-fuel ratio higher than said predetermined air-fuel ratio for a second combustion chamber of said engine during all operations of said engine, third means for sensing a first load condition in which the load of said engine is below a predetermined value and a second load condition in which the load of said engine is above said predetermined value and for producing first and second control signals representative of said first and second load conditions, respectively, fourth means for sensing a temperature of exhaust gas of said engine which is above a predetermined value and for producing a third control signal representative of said temperature, fifth means for sensing a concentration of oxygen in exhaust gas of said engine which is below a predetermined value and for producing a fourth control signal representative of said concentration, and sixth means for causing said first air-fuel mixture forming means to form said rich air-fuel mixture under a first condition in which said third means produces said first control signal and at least one of said fourth and fifth means fails to produce the corresponding control signal and for causing said first air-fuel mixture forming means to form said lean air-fuel mixture under a second condition in which said third, fourth and fifth means produce said second, third and fourth control signals, respectively.

9. An apparatus as claimed in claim 8, in which said predetermined air-fuel ratio is a stoichiometric air-fuel ratio.

10. An apparatus as claimed in claim 8, in which said first air-fuel mixture forming means comprises first air feeding passage means for feeding air for said first combustion chamber, and a first fuel injection valve for feeding fuel into said air feed for said first combustion chamber, said second air-fuel mixture forming means comprising second air feeding passage means for feeding air for said second combustion chamber, and a second fuel injection valve for feeding fuel into said air feed for said second combustion chamber, first control means comprising a first pulse generator normally connected to said first fuel injection valve and generating a first pulse signal having a pulse width which causes said first fuel injection valve to inject fuel for forming said rich air-fuel mixture, a second pulse generator connectable to said first fuel injection valve and connected to said second fuel injection valve and generating a second pulse signal having a pulse width which is narrower than said pulse width of said first pulse signal and which causes said first and second fuel injection valves to inject fuel for forming said lean air-fuel mixture, and second control means for controlling said pulse widths of said first and second pulse signals in accordance with the load of said engine, and said sixth means comprises switching-over means for providing connection between said first pulse generator and said first fuel injection valve under said first condition and for switching over connection of said first fuel injection valve from said first pulse generator to said second pulse generator under said second condition.

11. An apparatus as claimed in claim 10, in which said switching-over means comprises a switching relay having first and second stationary contacts connected to said first fuel injection valve, a first movable contact connected to said first pulse generator and, under said first condition, connected to said first stationary contact, a second movable contact connected to said second pulse generator and, under said first condition, disconnected from said second stationary contact, and a relay coil energized in response to said second condition to disconnect said first movable contact from said first stationary contact and to connect said second movable contact to said second stationary contact.

* * * * *